United States Patent [19]

Fette

[11] Patent Number: 4,742,550

[45] Date of Patent: May 3, 1988

[54] 4800 BPS INTEROPERABLE RELP SYSTEM

[75] Inventor: Bruce Fette, Mesa, Ariz.

[73] Assignee: Motorola, Inc., Schaumburg, Ill.

[21] Appl. No.: 651,010

[22] Filed: Sep. 17, 1984

[51] Int. Cl.[4] ..... G10L 5/00

[52] U.S. Cl. ..... 381/36

[58] Field of Search ..... 381/29–40

[56] References Cited

U.S. PATENT DOCUMENTS

| | | | |
|---|---|---|---|
| 4,330,689 | 5/1982 | Kang et al. | 179/15.55 R |
| 4,378,469 | 3/1983 | Fette | 179/1.5 M |
| 4,392,018 | 7/1983 | Fette | 179/1.5 M |

OTHER PUBLICATIONS

MIT, "The Lincoln Digital Voice Terminal System", Electronics Systems Division, Aug. 25, 1975.

Tempest Voice Digitizer, ILEX Systems (Jun. 1984).

Vopac, ILEX Systems (Mar., 1984).

*Primary Examiner*—Emanuel S. Kemeny

*Attorney, Agent, or Firm*—Maurice J. Jones, Jr.; Raymond J. Warren

[57] ABSTRACT

An apparatus and method is disclosed of providing higher quality speech transmission and reproduction. The present invention consists of a standard 2400 BPS transmitter with the addition of an additional 2400 BPS through a residual signal combined with the standard 2400 BPS signal. The addition of the residual signal gives more information about the speech signal being transmitted and allows more accurate reconstruction of the speech based on the received digital signal. The residual signal is adjusted to phase-align all frequency components to zero, then quantizing only the positive half of the residual signal now symmetric about zero time.

17 Claims, 3 Drawing Sheets

4800 BPS INTEROPERABLE RELP SYSTEM

BACKGROUND OF THE INVENTION

1. Field of the Invention

This invention relates, in general, to a voice analyzer apparatus and, more particularly, to a voice analyzer apparatus utilizing a residual excited linear predictive (RELP) coder that operates at 4800 BPS (bits per second) and is interoperable with a 2400 BPS system.

2. Description of the Background

Much work has been done in the area of human voice analyzing apparatuses. One of the more important developments for this is linear predictive coding (LPC). LPC is a mathematical procedure for estimating a filter function equivalent to the vocal tract. The estimate of the vocal tract resonance may be used to subtract vocal tract resonances from speech leaving an estimate of the excitation. The vocal tract function is estimated by removing correlation between a number of adjacent samples of the speech waveform, assuming that the wavefore may be modeled as an exponentially decaying sinusoid. A typical apparatus for providing the LPC correlation, excitation and amplitude information is disclosed in U.S. Pat. No. 4,378,469, issued to the inventor of the present invention and entitled "Human Voice Analyzing Apparatus".

Systems which operate at 2400 BPS provide, as vocal tract excitations, a unit pulse at certain intervals. This produces a sound that is of insufficient quality for commercial applications and has a mechanical tone to it.

SUMMARY OF THE INVENTION

Accordingly, it is an object of the present invention to provide an interoperable RELP apparatus and method of producing a higher quality speech signal.

A further object of the present invention is to provide an interoperable RELP apparatus and method capable of operating at 4800 BPS.

Still another object of the present invention is to provide an interoperable RELP apparatus and method operable between 2400 BPS and 4800 BPS.

Yet another object of the present invention is to provide an interoperable RELP apparatus and method capable of economically modifying existing equipment.

The above and other objects and advantages of the present invention are provided by an interoperable RELP apparatus and method capable of operating a voice coder at 4800 BPS through the modification of the software and minor adjustments in circuitry of existing 2400 BPS systems. The additional 2400 BPS are used to provide an improved vocal quality to the transmission. The present system is interoperable with 2400 BPS in that it can transmit and receive a 2400 BPS signal in addition to a 4800 BPS signal.

A particular embodiment of the present invention comprises an interoperable RELP apparatus and method capable of expanding a 2400 BPS signal received by the present invention to 4800 BPS and, conversely, reducing a 4800 BPS to 2400 BPS to be transmitted to a 2400 BPS receiver.

DETAILED DESCRIPTION OF THE INVENTION

Figure 1:
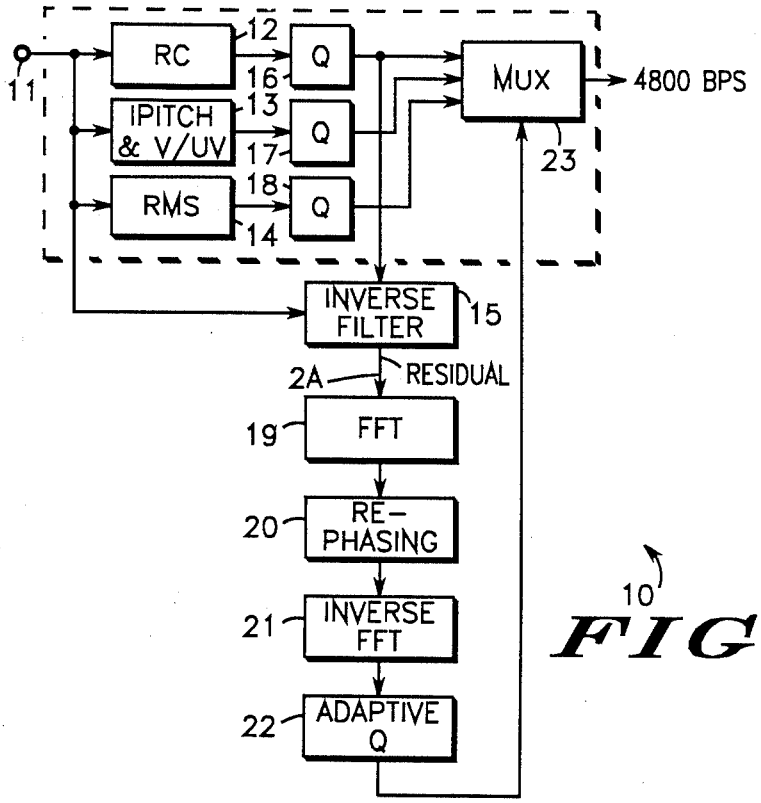
FIG. 1 is a block diagram of a transmitter embodying the present invention.

Referring now to FIG. 1 a block diagram of a 4800 BPS transmitter generally designated 10, is illustrated. Transmitter 10 has an input node 11 for receiving a speech signal input. Node 11 is coupled to the inputs of a linear predictive analysis function device 12; a pitch-/voicing circuit 13; a root-mean-square circuit 14 (as in a 2400 BPS transmitter); and to the input of a dual input inverse filter 15. LPC analyzer 12 produces a reflection coefficient signal, RC, which provides approximately 16 percent of the standard 2400 BPS system, as will be illustrated further below. Pitch and voicing circuit 13 produces a pitch signal and a voiced/unvoiced, V/UV, signal. The pitch signal represents the frequency of the vocal cords for the particular sounds. The V/UV signal indicates whether vocal cords are being used by being either logically on or off. The pitch signal comprises approximately 11 precent of the standard 2400 BPS signal and the V/UV signal approximately two percent of the standard 2400 BPS signal. Root-mean-square circuit 14 produces an RMS signal of the speech input which comprises approximately nine percent of the standard 2400 BPS signal. The outputs of LPC analyzer 12, pitch/voicing circuit 13 and RMS circuit 14 are transmitted to quantizers 16,17 and 18, respectively. The output from quantizer 16 is then transmitted to the second input of inverse filter 15.

Figure 2:
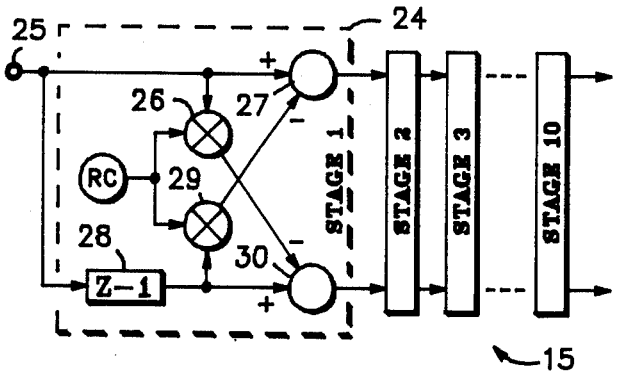
FIG. 2 is a block diagram of the inverse filter of FIG. 1.

Referring now to FIG. 2 a more detailed block diagram of inverse filter 15 is illustrated. Filter 15 is comprised of 10 stages the first of which is designated 24. Stages 2 through 10 are essentially identical to stage 1 except where indicated below. Stage 1 receives a speech input signal from a node 25. This is transmitted to one input of a dual input multiplier 26; to an input of a dual input subtracter 27; and to the input of a delay 28. The output from delay 28 is coupled to an input of a dual input multiplier 29 and into an input of a dual input subtracter 30. Coupled to the remaining inputs of mixers 26 and 29 are the quantized reflection coefficient signals provided by quantizer 16. The resulting signals from multipliers 26 and 29 are then transmitted to the second inputs of subtracters 30 and 27, respectively. The outputs from subtracters 27 and 30 are then transmitted to stage 2 where the above process is repeated, however, the quantized value of each stage from quantizer 16 differs. As illustrated in FIG. 2 the parallel outputs of stage 1 are input to the parallel inputs of stage 2. This continues on to stage 10 where one of the outputs (the forward residual) is utilized as the residual signal and the other output is discarded. This produces the residual speech signal that is transmitted to a Fourier transform 19. By way of example, this filter may be implemented on a single microprocessor chip, such as the MC 68000 produced by Motorola, Inc., by implementing the following software routine.

```
C   SOFTWARE FOR INVERSE FILTER
    SUBROUTINE INVERSE (SPEECH, RCHAT, RESIDL)
    DIMENSION SPEECH(180,RCHAT(10),RESIDL(180),
    BRSDL(10)
C   SPEECH IS INPUT SPEECH
C   RCHAT IS QUANTIZED REFLECTION COEFFICIENT
C   RESIDL IS RESIDUAL SPEECH OUT
C   FRSDL IS FORWARD RESIDUAL
C   BRSDL IS BACKWARD RESIDUAL
C   BRL IS BACKWARD RESIDUAL FROM LAST STAGE
C   FRO IS FORWARD RESID OUT OF THIS STAGE
C   BRO IS BACKWARD OUT OF THIS STAGE
    DO 200 N=1, 10
    FRO=SPEECH (N)
    BRL=FRSDL
    DO 100 I=1, 10
    FRO=FRSDL-RCHAT(I) × BRSDL(I)
    BRO=BRSDL(I)RCHAT(I) × FRSDL
    FRSDL=FRO
    BRSDL(I)=BRL
100 BRL=BRO
200 RESIDL(N)=FRO
    RETURN
    END
C
C   MICROCODE FOR INVERSE FILTER
WAIT:JIF ADNR WAIT
    A/D>FR,T3
LOOP:FR>X
    KI>Y*
    BR>A-
    P>-B
    BR>X
    KI>Y*
    T3>BR
    S>T3
    P>-B
    FR>A-
    S>FR
    JIF NOT10 LOOP
    JMP WAIT
```

Referring to FIG. 1, the output of inverse filter 15 is a residual speech signal consiting of the speech waveform components not described by the output of the quantizers and is tansmitted on line 2A to a fast Fourier transform 19. The output of fast Fourier transform 19 is coupled to a rephasing circuit 20 to zeroize the phase of all the components. The output of circuit 20 is then transmitted to the input of an inverse fast Fourier transform circuit 21 and from there to an adaptive positive time quantizer 22 which will be discussed in more detail below. The outputs from quantizers 16, 17, 18 and 22 are transmitted to serializer 23. The output of serializer 23 is then transmitted at 4800 BPS. Circuits 12, 13 and 14; quantizeers 16, 17 and 18; and serializer 23 represent a standard 2400 BPS system 60, shown in FIG. 1. A more detailed description and diagram of a 2400 BPS synthesizer may be seen in U.S. Pat. No. 4,392,018 issued to the inventor of the present invention. A switch, not shown, may be coupled with serializer 23 to switch the circuit between 2400 and 4800 BPS as desired. The remainder of the components of this diagram provide the additional 2400 BPS which results in the 4800 BPS output signal. The quantized signals are received and converted back to speech as described in detail in conjunction with FIG. 6 below.

Figure 3A:
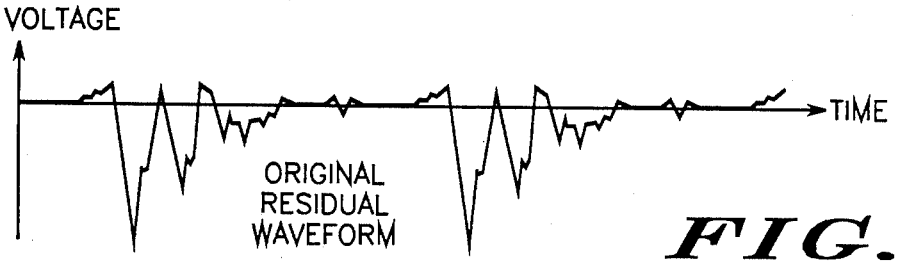
FIGS. 3A and 3B are examples of a waveform generated at different points by the present invention.
Figure 3B:
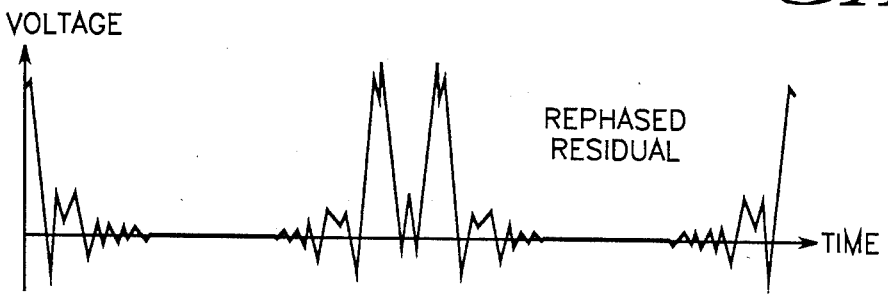

Filter 15 produces a residual speech signal which is illustrated in FIG. 3A. The residual speech signal is then transmitted to fast Fourier transform circuit 19 where it is transformed from a time dependent signal to a frequency dependent signal. This signal is next transmitted to a rephasing circuit 20 which adjusts all of the components to have a "0" phase angle. This rephased signal is then transmitted to inverse fast Fourier transform circuit 21 where the signal is transformed back to a time dependent signal. Fast Fourier transform 19, rephasing circuit 20 and inverse fast Fourier transform 21 are well known in the art and will not be discussed in detail here. The signal from inverse fast Fourier transform 19 is illustrated in FIG. 3B and has each impulse symmetric and centered about a "0" time line. These rephased signals are then transmitted to quantizer 22. Quantizer 22 takes the rephased signal and quantizes the positive side of the signal only. Quantizer 22 then provides the additional 2400 BPS to serializer 23 which provides an output of 4800 BPS.

The standard bits for a 2400 BPS voiced/unvoiced signal are illustrated in Table 1 below.

TABLE 1

| VOICED BITS | | UNVOICED BITS | |
|---|---|---|---|
| RMS Energy | 5 | RMS Energy | 5 |
| RC(1) | 5 | RC(1) | 5 |
| RC(2) | 5 | RC(2) | 5 |
| RC(3) | 5 | RC(3) | 5 |
| RC(4) | 5 | RC(4) | 5 |
| RC(5) | 4 | Pitch & Voice | 7 |
| RC(6) | 4 | Sync | 1 |
| RC(7) | 4 | Hamming Error Protection | |
| RC(8) | 4 | RMS | 4 |
| RC(9) | 3 | RC(1) | 4 |
| RC(10) | 2 | RC(2) | 4 |
| Pitch & Voice | 7 | RC(3) | 4 |
| Sync | 1 | RC(4) | 4 |
| | | Spare | 1 |
| | 54 | | 54 |

In a voiced signal five bits are assigned to RMS; 41 bits for the ten reflection coefficients (RC); seven bits for the pitch and voice/unvoiced signal and one bit for synchronization. These 54 bits are provided for each 22.5 millisecond sampling period thereby producing 2400 BPS. In the unvoiced signal illustrated in Table 1 five bits are provided for the RMS signal; 20 for the reflection coefficients; seven for the pitch and voice/unvoice signal; and one for the sychronization signal. In addition to these signals, which are the equivalent of the voiced signals, Hamming error protection bits are provided to insure that the above bits are accurately received. The Hamming error protection bit consists of four bits for the RMS signal; 16 bits for the reflection coefficient signal and one spare. This gives the 54 bits/sample required for the 2400 BPS system.

The additional 2400 BPS that are provided from time quantizer 22 are illustrated in Table 2 below.

TABLE 2

| VOICED BITS | | UNVOICED BITS | |
|---|---|---|---|
| Error Protection | | RC(5) | 4 |
| RMS | 4 | RC(6) | 4 |
| RC(1) | 4 | RC(7) | 4 |
| RC(2) | 4 | RC(8) | 4 |
| Position 1st Pulse | 8 | RC(9) | 3 |
| Error Correct 1st Pulse | 4 | RC(10) | 2 |
| Relative Amplitude | | Interpolation Contour | |
| E1/E0 | 5 | RMS | 3 |
| E2/E0 | 5 | RC(1) | 3 |
| E3/E0 | 5 | RC(2) | 3 |
| E4/E0 | 5 | RC(3) | 3 |
| E5/E0 | 2 | RC(4) | 3 |
| E6/E0 | 2 | RC(5) | 3 |
| E7/E0 | 2 | RC(6) | 3 |
| E8/E0 | 2 | Plosive Burst | 1 |
| Side Data | 1 | 1st Half FRM | |
| Sync | 1 | Plosive Burst | 1 |
| | 54 | 2nd Half FRM | |

TABLE 2-continued

| VOICED BITS | UNVOICED BITS | |
|---|---|---|
| | Pitch & Voicing | 7 |
| | Previous FRM | |
| | Logic Zero | 1 |
| | Side Data | 1 |
| | Sync | 1 |
| | | 54 |

Figure 4:
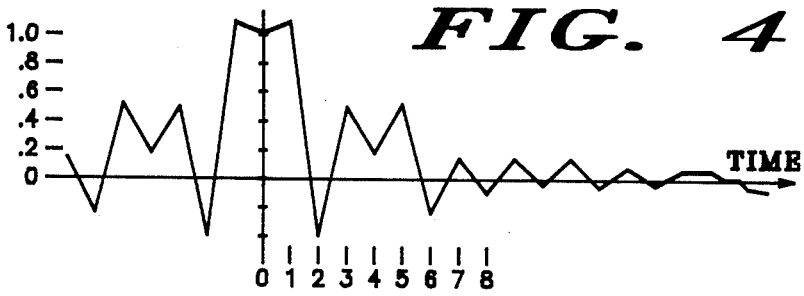
FIG. 4 is a diagram of a digitized symmetrical excitation waveform.

In the voiced sample there are 12 Hamming error correction bits consisting of four correction bits each for RMS, RC(1), and RC(2). These, as above for unvoiced, ensure that the most important parameters for speech synthesis are received accurately in spite of transmission errors due to noise in the communication channel. Next, an eight bit positioning signal for the first pulse is included which describes to the receiver where to place the first symmetrical excitation pulse in the first frame. Since there are 180 samples in a frame, eight bits define the sample time where the center of the excitation wave will be placed. The next four bits provide a Hamming error protection code for the eight bit positioning pulse. The next 28 bits represent the relative amplitude of a digitized symmetrical excitation waveform as shown in FIG. 4. The central sample point E0 is normalized to be exactly unit amplitude, and the eight adjacent positive time values are scaled relative to this. Due to the nature of the symmetrical conversion algorithm, all spectrally significant components of the excitation may be represented in 17 samples from $t=-8$ to $t=8$. These fractional amplitudes are quantized and transmitted with five and two bit accuracy as illustrated below in Tables 3 and 4, respectively.

TABLE 3

| Input Range | | | |
|---|---|---|---|
| From | To | Code | Synthesis Value |
| .9375 | +0000 | 15 | .96875 |
| .8750 | .9375 | 14 | .90625 |
| .8125 | .8750 | 13 | .84375 |
| .7500 | .8125 | 12 | .78125 |
| .6875 | .7500 | 11 | .71875 |
| .6250 | .6875 | 10 | .65625 |
| .5625 | .6250 | 9 | .59375 |
| .5000 | .5625 | 8 | .53125 |
| .4375 | .5000 | 7 | .46875 |
| .3750 | .4375 | 6 | .40625 |
| .3125 | .3750 | 5 | .34375 |
| .2500 | .3125 | 4 | .28125 |
| .1875 | .2500 | 3 | .21875 |
| .1250 | .1875 | 2 | .15625 |
| .0625 | .1250 | 1 | .09375 |
| .0000 | .0625 | 0 | .03125 |
| −.0625 | .0000 | −1 | −.03125 |
| −.1250 | −.0625 | −2 | −.09375 |
| −.1875 | −.1250 | −3 | −.15625 |
| −.2500 | −.1875 | −4 | −.21875 |
| −.3125 | −.2500 | −5 | −.28125 |
| −.3750 | −.3125 | −6 | −.34375 |
| −.4375 | −.3750 | −7 | −.40625 |
| −.5000 | −.4375 | −8 | −.46875 |
| −.5625 | −.5000 | −9 | −.53125 |
| −.6250 | −.5625 | −10 | −.59375 |
| −.6875 | −.6250 | −11 | −.65625 |
| −.7500 | −.6875 | −12 | −.71875 |
| −.8125 | −.7500 | −13 | −.78125 |
| −.8750 | −.8125 | −14 | −.84375 |
| −.9375 | −.8750 | −15 | −.90625 |
| −.0000 | −.9375 | −16 | −.96875 |

TABLE 4

| Input Range | | | |
|---|---|---|---|
| From | To | Code | Synthesis Value |
| .30 | .00 | 1 | .45 |
| .00 | .30 | 0 | .15 |
| −.30 | .00 | −1 | −.15 |
| −.00 | −.30 | −2 | −.45 |

Figure 5:
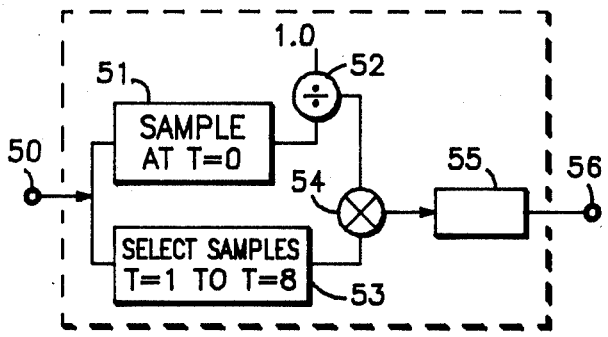
FIG. 5 is a block diagram of the symmetrical wave quantizer of FIG. 1.

These fractional amplitudes are quantized and transmitted with five and two bit accuracy, as illustrated above. In the tables the input range is given followed by the actual code transmitted and the synthesis value at the receiver. As is illustrated each value is a fraction. This results from the normalized center value, E0 of FIG. 4, being set to unit amplitude. The same is true for Table 4. A block diagram of this is shown in FIG. 5. A symmetric excitation wave enters at a node 50. A sample is taken at time $t=0$, in sampler 51, and is normalized, to be exactly unit amplitude, in divider 52. This provides the normalization scale factor. Samples are also taken for time $t=1$ to $t=8$ at sampler 53. These samples are then mixed with the normalization scale factor in a mixer 54 to produce normalized positive time values. These values are then quantized in quantizer 55, samples 1–4 being quantized for five bits and samples 5–8 being quantized for two bits as shown above in Tables 3 and 4, respectively. The quantized symmetric excitation bits E1/E0–E8/E0 are then transmitted out at node 56. The synthesizer will place this quantized symmetric excitation wave first at the sample time, indicated by the eight bit plus the four bit error correction, pulse placement signal. Succesive excitation symmetric pulses will be placed relative to the first placement at a spacing indicated by the pitch period in the standard 2400 BPS data stream, Table 1.

The extra 2400 BPS signal also includes one bit for side data which may be any low rate digital data external to the vocoder which will be passed over the data link asynchronously at 44 BPS. This bit will be a one whenever the side data channel is idle. When the side data channel is about to pass data it will send a zero bit, or start bit, followed by successive frames of eight data bits. The data stream is followed by two one bits, or stop bits. These bits will be separated at the receiver and passed to an external data device and may be used for other system functions. The second sync bit is identical to the sync bit of Table 1 and toggles every frame.

In the unvoiced signal, Table 2, it is impractical to code the excitation as a symmetrical pulse with a given repetition rate since unvoiced excitation is a random noise. Thus, for unvoiced speech, the synthesizer will locally generate a pseudo-random excitation burst as it does for the standard 2400 BPS data flow. Therefore, the 54 bits available per frame are used to improve the voice quality. The first 21 bits are used to send reflection coefficients 5–10 so that the speech is always 10 pole LPC quality. Next, 21 bits are used for interpolation contour for RMS and RC(1)–RC(6). The interpolation contour allows the reconstruction of the vocal tract shape to adapt properly to both mid frame and end of frame, allowing a more accurate reconstruction of consonants. Two positive burst bits, one for the first half and one for the second half of the frame, are utilized to indicate to the synthesizer whether to create four impulses of random spacing in either the first or second half of the frame. These impulses allow the synthesizer to more accurately model the impulsive excitation necessary for p, t, k, and ch sounds. The next seven bits are for the pitch and voiced/unvoiced signal of the previous frame which allows for correction of transmission errors which would incorrectly indicate to the receiver the pitch and voiced/unvoiced condition. One bit is then provided for a logic zero which allows automatic adaption to polarity errors in modem or other interface logic. Following this is two bits, one each for side data and sync, which are described above in the voiced application.

This process compresses the important speech components into a symmetrical short duration waveform near zero time. This is then simplified further by quantizing and transmitting only half of this symmetric waveform. The residual signal contains all spectral information which is necessary for speech naturalness but is not contained in the original 2400 BPS signal transmission. The rephased residual signal also contains all the same spectral components which lead to naturalness, but they have been condensed into a much more compact form by the rephasing process.

Figure 6:
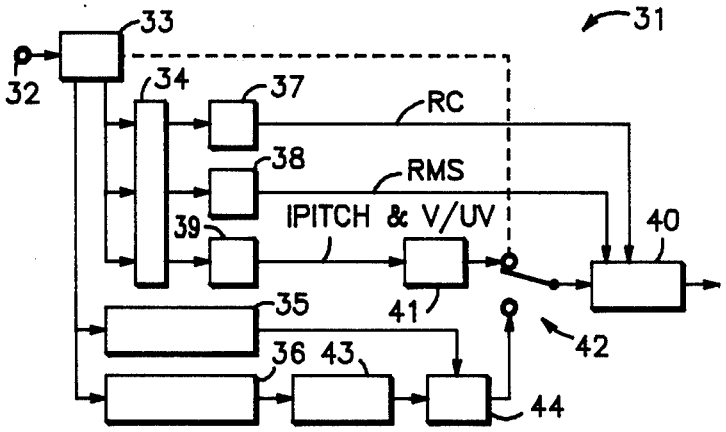
FIG. 6 is a block diagram of a receiver embodying the present invention.

Referring now to FIG. 6 a block diagram of a 2400/4800 BPS receiver, generally designated 31, is illustrated. Receiver 31 receives a digitized serial signal at a node 32. This signal is then transmitted to a deserializer 33. Deserializer 33 is coupled to an error correcting circuit 34 for three of the outputs; to a position determining circuit 35; and to a denormalizer 36. The signals from the outputs of error corrector 34 are transmitted to inverse quantizers 37, 38 and 39. Inverse quantizers 37, 38 and 39 reconstruct the reflection coefficient, RMS, pitch and V/UV signals. The outputs of inverse quantizers 37 and 38 are coupled to a synthesizer 40. The output of inverse quantizer 39 is coupled to a buzz/hiss exciter 41. The output of exciter 41 is coupled to a switch 42 which is controlled by deserializer 33. The output of denormalizer 36 is coupled to a circuit 43 which makes the impulse symmetrical. The output of circuits 35 and 43 are input to circuit 44 to place the residual impulse. The output of circuit 44 is coupled to switch 42. The output of switch 42 is coupled to synthesizer 40. Synthesizer 40 then produces the speech output.

The signal received by deserializer 33 is divided into its original components, of these the LPC, RMS, pitch and V/UV signals are transmitted to error correction device 34. This provides for the correction of bits which were received in error due to noise in the transmission channel. These three signals are then transmitted through inverse quantizers 37, 38 and 39. The LPC and RMS signals are transmitted directly to synthesizer 40. The pitch and V/UV signals are transmitted to exciter 41. The output from exciter 41 is transmitted to switch 42. If the signal received by deserializer 33 is a 2400 BPS signal, which can be determined from the clock signal, then deserializer 33 activates switch 42 to couple exciter 41 to synthesizer 40. If the signal received by deserializer 33 is operating at 4800 BPS then a decision must be made whether this is a 4800 BPS signal or an expanded 2400 BPS signal. This is accomplished by looking at the number of 1's and 0's in the signal. When a 2400 BPS signal is expanded to 4800 BPS the additional 2400 BPS are 0's added between each bit of the regular 2400 BPS signal. If the 4800 BPS signal received has a vast amount of 0's in its string then switch 42 is coupled to the 2400 BPS design. If the number of 1's and 0's present are relatively equivalent then switch 42 is set to couple circuit 44 to synthesizer 40. In the 4800 BPS mode deserializer 33 provides a signal to time positioning circuit 35 and to denormalizer 36. Circuit 35 determines the time position of each impulse. Denormalizer 36 reconstructs the positive half of the residual signal transmitted. This positive half of the signal is then transmitted to circuit 43 where a negative half of the signal is reconstructed by making the impulse symmetrical. The reconstructed signal is then transmitted to circuit 44 which, using a time positioning signal from circuit 35, places the symmetrical impulses from circuit 43 at their proper position. This signal is then transmitted to synthesizer 40 through switch 42. In other words, this process consists of decoding the excitation codes as indicated in Tables 3 and 4, and copying then into both positive and negative time samples symmetrically about the time indicated in the first pulse placement bits. Next, the excitation wave is placed later in the frame at sample time spaced by the pitch period away from the first pulse. Finally, the synthesizer will evaluate the composite energy of the excitation over the pitch epoch and renormalize it to unit amplitude, thus accomodating energy variations resulting from excitation waveshape variations. This excitation is then applied to a conventional synthesis filter structure and the synthetic speech output is then modulated by the RMS control.

Note that the symmetrical excitation waveform is very peaked in nature and should be passed through an all pass filter in order to maximize the dynamic range of the LPC synthesis filter and to restore natural phase distribution. An eight pole all pass filter network filter is recomended for this, which may be a normal part of the existing LPC synthesizer filter.

Figure 7A:
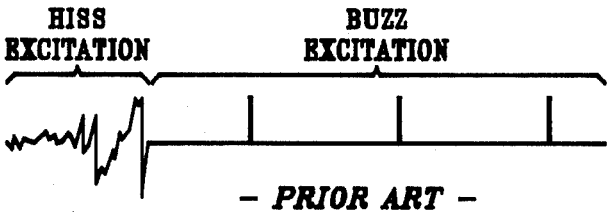
FIGS. 7A and 7B illustrate a prior art waveform, 7A, as compared to a waveform produced by the present invention, 7B.
Figure 7B:
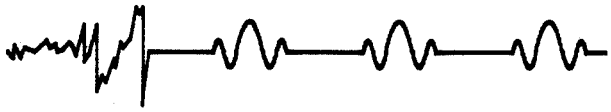

By operating at 4800 BPS, rather than 2400 BPS, a more accurate speech signal is reconstructed at the receiving end. By way of example, FIGS. 7A and 7B represent two different signals. FIG. 7A represents the excitation signal being used by the receiver in exciting 2400 BPS equipment. At 2400 BPS there is only enough information available to reconstruct the time position of a pulse signal. While this is audible the resultant sound is a very mechanical sounding speech. By operating at 4800 BPS an excitation signal such as FIG. 7B can be reconstructed. At 4800 BPS twice the information is transmitted which allows the receiver to more accurately reconstruct the speech.

Much of the transmitter, FIG. 1, and receiver, FIG. 6, are contained on a single microchip, such as the MC 68000 produced by Motorola, Inc. Utilizing a microprocessor allows the same circuitry to be utilized for multiple purposes by executing differing software instructions. For example the same circuitry may be used as quantizers 16, 17 and 18 and serializer 23 of FIG. 1 and as deserializer 33 and dequantizers 37, 38 and 39 of FIG. 6. As a result, many existing 2400 BPS designs can be modified to operate at 4800 BPS with a change in the software and a minimal change in circuitry. Thus, making the present design very economical to implement.

Thus, it is apparent that there has been provided, in accordance with the invention, a device and method that fully satisfies the objects, aims and advantages set forth above.

It has been shown that the present invention is capable of operating at 4800 BPS and thereby providing a higher fidelity sound. It has been shown further that the present invention is capable of operating in either 2400 BPS or 4800 BPS modes and that current 2400 BPS system may econmically be converted to 4800 BPS systems.

While the invention has been described in conjunction with specific embodiments thereof, it is evident that many alterations, modifications and variations will be apparent to those skilled in the art in light of the foregoing description. Accordingly, it is intended to embrace all such alternatives, modifications and variations which fall within the spirit and scope of the appended claims.

What is claimed is:

1. A residual excited linear predictive coder having a speech input and a speech output, comprising:

filter means for producing a residual speech signal, said filter means having a first input, a second input and an output, said first input being coupled to said speech input of said RELP;

Fourier transform means for converting said residual signal from a time dependent signal to a phase dependent signal, said Fourier transform means having an input and an output, said input being coupled to said output of said filter means;

phase aligning means for setting all components of said residual speech signal to zero phase, said phase aligning means having an input and an output, said input being coupled to said output of said Fourier transform means;

inverse Fourier transform means for converting said residual speech signal from a phase dependent signal to a time dependent signal, said inverse Fourier transform means having an input and an output, said input being coupled to said output of said phase aligning means;

adaptive positive time quantizer means for quantizing the positive half of said residual speech signal, said adaptive positive time quantizer means having an input and an output, said input being coupled to said output of said inverse Fourier transform means;

linear predictive coder means for producing an reflective coefficient signal, said linear predictive coder means having an input and an output, said input being coupled to said speech input of said RELP;

a first quantizer having an input and an output, said input being coupled to said output of said linear predictive coder and said output being coupled to said second input of said filter means;

pitch voicing means for producing a pitch signal and a voice/unvoice signal, said pitch voicing means having an input and an output, said input being coupled to said speech input of said RELP;

a second quantizer having an input and an output, said input being coupled to said output of said pitch voicing means;

root-mean-square means for producing an RMS signal of said speech signal, said root-mean-square means having an input and an output, said input being coupled to said speech input of said RELP;

a third quantizer having an input and an output, said input being coupled to said output of said root-mean-square means;

serializing means for serializing the signals from said first, second and third quantizers and said adaptive positive time quantizer means, said serializing means having a first input, a second input, a third input, a fourth input and an output, said first input being coupled to said output of said first quantizer, said second input being coupled to said output of said second quantizer, said third input being coupled to said output of said third quantizer, said fourth input being coupled to said output of said adaptive positive time quantizer means and said output being coupled to transmit a coded signal;

deserializer means for deserializing said coded signal received from said serializing means, said deserializer means having an input, a first output, a second output, a third output, a fourth output, and a fifth output, said input being coupled to receive said coded signal;

error correction means for correcting the error caused in transmission of said signal, said error correction means having a first input, a second input, a third input, a first output, a second output and a third output, said first input being coupled to said fourth output of said deserializer means, said second input being coupled to said third output of said deserializer means and said third input being coupled to said second output of said deserializer means;

a first inverse quantizer having an input and an output said input being coupled to said first output of said error correction means;

a second inverse quantizer having an input and an output, said input being coupled to said second output of said error correction means;

a third inverse quantizer having an input and an output, said input being coupled to said third output of said error correction means;

synthesizer means for combining a plurality of signals, said synthesizer means having a first input, a second input, a third input and an output, said first input being coupled to said output of said first quantizer, said second input being coupled to said output of said second quantizer and said output being coupled to said output of said RELP;

an exciter having an input and an output, said input being coupled to said output of said third inverse quantizer;

position determining means for determining the position of each impulse of said signal, said position determining means having an input and an output, said input being coupled to said first output of said deserializing means;

denormalizing means for reconstructing a positive half of said signal, said denormalizing means having an input and an output, said input being coupled to said first output of said deserializing means;

symmetrical means for generating the negative portion of said signal from said positive portion, said symmetrical means having an input and an output said input being coupled to said output of said denormalizing means;

positioning means for placing each impulse of said signal in the proper position, said positioning means having a first input, a second input and an output, said first input being coupled to said symmetrical means and said second input being coupled to said output of said position determining means; and a switch having a control line, a first pole, a second pole, a first position and a second position, said control line being coupled to said fifth output of said synthesizer, said first pole being coupled to said output of said exciter, said second pole being coupled to said output of said positioning means, said first position coupling said output of said exciter to said third input of said synthesizer and said second position coupling said output of said positioning means to said third input of said synthesizer.

2. The RELP coder of claim 1 wherein said filter means of said transmitter comprises:

a first stage having a first input, a second input, a third input a first output and a second output, said first and said second inputs being coupled to said first input of said filter means and said third input being coupled to said second input of said filter means;

a subsequent stage having a first input, a second input, a third input, a first output and a second output, said first input being coupled to said first output of said first stage, said second input being coupled to said second output of said first stage and said third input being coupled to said second input of said filter means; and a final stage having a first input, a second input, a third input, a first output and a second output, said first input being coupled to said first output of said subsequent stage, said second input being coupled to said second output of said subsequent stage, said third input being coupled to said second input of said filter means, said first output being coupled to said output of said filter means and said second output being discarded.

3. The RELP coder of claim 2 wherein said first stage of said filter means of said transmitter comprises:

a first multiplier having a first input, a second input and an output, said first input being coupled to said first input of said first stage and said second input being coupled to said third input of said first stage;

a delay having an input and an output, said input being coupled to said second input of said first stage;

a second multiplier having a first input, a second input and an output, said first input being coupled to said output of said delay and said second input being coupled to said third input of said first stage;

a first subtractor having a positive input, a negative input and an output, said positive input being coupled to said first input of said first stage, said negative input being coupled to said output of said second multiplier and said output being coupled to said first output of said first stage; and a second subtractor having a positive input, a negative input and an output, said positive input being coupled to said output of said delay, said negative input being coupled to said output of said first multiplier and said output being coupled to said second output of said first stage.

4. The RELP coder of claim 3 wherein said subsequent stage of said filter means of said transmitter comprises:

a first multiplier having a first input, a second input and an output, said first input being coupled to said first input of said subsequent stage and said second input being coupled to said third input of said subsequent stage;

a delay having an input and an output, said input being coupled to said second input of said subsequent stage;

a second multiplier having a first input, a second input and an output, said first input being coupled to said output of said delay and said second input being coupled to said third input of said subsequent stage;

a first subtractor having a positive input, a negative input and an output, said positive input being coupled to said first input of said subsequent stage, said negative input being coupled to said output of said second multiplier and said output being coupled to said first output of said subsequent stage; and a second subtractor having a positive input, a negative input and an output, said positive input being coupled to said output of said delay, said negative input being coupled to said output of said first multiplier and said output being coupled to said second output of said subsequent stage.

5. The RELP coder of claim 4 wherein said final stage of said filter means of said transmitter comprises:

a first multiplier having a first input, a second input and an output, said first input being coupled to said first input of said final stage and said second input being coupled to said third input of said final stage;

a delay having an input and an output, said input being coupled to said second input of said final stage;

a second multiplier having a first input, a second input and an output, said first input being coupled to said output of said delay and said second input being coupled to said third input of said final stage;

a first subtractor having a positive input, a negative input and an output, said positive input being coupled to said first input of said final stage, said negative input being coupled to said output of said second multiplier and said output being coupled to said first output of said final stage; and a second subtractor having a positive input, a negative input and an output, said positive input being coupled to said output of said delay, said negative input being coupled to said output of said first multiplier and said output being coupled to said second output of said final stage.

6. The RELP coder of claim 5 wherein said RELP further comprises a switch having a first position and a second position, said first position of said switch coupling said output of said adaptive positive time quantizer to said fourth input of said serializing means and said second position of said switch decoupling said output of said adaptive positive time quantizer from said fourth input of said serializing means.

7. A method of providing a residual excited linear predictive coder having the steps of:

providing a speech signal:

deriving a reflective coefficient signal, a pitch signal, a voice/unvoice signal and a root means square signal from said speech signal;

quantizing said reflective coefficient, pitch, voice/unvoice, and root means square signals;

filtering said speech signal producing a residual speech signal;

converting said residual speech signal from a time dependent signal to a frequency dependent signal in a fast Fourier transform device;

centering said frequency dependent signal about a zero time line in a rephasing circuit producing a rephased signal;

converting said rephased signal from a frequency dependent signal to a time dependent signal in an inverse fast Fourier transform circuit producing a symmetric and centered signal;

quantizing the positive side of said symmetric and centered signal;

combining said quantized reflective coefficient, pitch, voice/unvoice, root means square and positive symmetric and centered signals in a serializer producing a 4800 bit per second signal; and transmitting said 4800 bit per second signal.

8. The method of claim 7 which further comprises the steps of:

receiving said 4800 bit per second signal;

deserializing said 4800 bit per second signal producing a reflective coefficient signal, a root means square signal, a pitch signal, a voice/unvoice signal and a residual signal;

correcting said reflective coefficient, root means square, pitch and voice/unvoice signals in an error correction device;

dequantizing said reflective coefficient, root means square, pitch and voice/unvoice signals;

transmitting said pitch and voice/unvoice signal to an exciter;

denormalizing said residual signal in a denormalizing circuit providing a denormalized signal;

reconstructing a negative portion of said denormalized signal in a symmetrical reconstruction circuit providing a symmetrical signal;

transmitting said residual signal to a positioning determining circuit for determining the position of said signal, said position determining signal producing a positioning signal;

transmitting said positioning signal and said symmetrical signal to a residual pulse place circuit producing a reconstructed residual signal;

transmitting said reconstructed residual signal to a first pole of a switch;

transmitting a signal from said exciter to a second pole of said switch;

operating said switch through a signal from said deserializer;

coupling said dequantizer reflective coefficient and root means square signals and a signal from said switch in a synthesizer producing said speech signal.

9. A residual excited linear predictive (RELP) coder operable at one of 2400 and 4800 bits per second having an input and an output, said RELP coder comprising:

a 2400 BPS transmitter having a first input, a second input, a first output and a second output, said first input being the input of said RELP coder and said second output being coupled to transmit a coded signal;

filter means for producing a residual speech signal, said filter means having a first input, a second input and an output, said filter means first input being coupled to said first input to said 2400 BPS transmitter and said second input being coupled to said first output of said 2400 BPS transmitter;

fourier transform means for coverting said residual signal from a time dependent signal to a phase dependent signal, said fourier transform means having an input and an output, said fourier transform means input being coupled to said output of said filter means;

means aligning means for setting all components of said residual speech signal to zero phase, said phase aligning means having an input and an output, said input being coupled to said output of said fourier transform means;

inverse fourier transform means for converting said residual speech signal from a phase dependent to a time dependent signal, said inverse fourier transform means having an input and an output, said input being coupled to said output of said phase aligning means;

adaptive positive time quantizer means for quantizing the positive half of said residual speech signal, said positive time quantizer means having an input and an output, said input being coupled to said output of said inverse fourier transform means and said output being coupled to said second input of said 2400 BPS transmitter; and a receiver operable at one of said 2400 and 4800 bits per second, said receiver having an input and an output, said input being coupled to receive said coded signal and said output being the output of said RELP coder.

10. The RELP coder of claim 9 wherein said 2400 BPS transmitter comprises:

linear predictive coder means for producing a reflection coefficient signal, said linear predictive coder means having an input and an output, said input being coupled to said first input of said 2400 BPS transmitter;

a first quantizer having an input and an output, said input being coupled to said output of said linear predictive coder;

pitch voicing means for producing a pitch signal and a voice/unvoice signal, said pitch voicing means having an input and an output, said input being coupled to said first input of said 2400 BPS transmitter;

a second quantizer having an input and an output, said input being coupled to said output of said pitch voicing means;

root-mean-square means for producing an RMS signal of said speech signal, said root-mean-square means having an input and an output, said input being coupled to said first input of said 2400 BPS transmitter;

a third quantizer having an input and an output, said input being coupled to said output of said root-mean-square means; and serializing means for serializing the signals from said first, second and third quantizers and said adaptive positive time quantizer means, said serializing means having a first input, a second input, a third input, a fourth input and an output, said first input being coupled to said output of said first quantizer, said second input being coupled to said output of said second quantizer, said third input being coupled to said output of said third quantizer, said fourth input being coupled to second input of said 2400 BPS transmitter and said output being coupled to said second output of said 2400 BPS transmitter.

11. The RELP coder of claim 9 wherein said filter means of said transmitter comprises:

a first stage having a first input, a second input, a third input a first output and a second output, said first and said second inputs being coupled to said first input of said filter means and said third input being coupled to said second input of said filter means;

a subsequent stage having a first input, a second input, a third input, a first output and a second output, said first input being coupled to said first output of said first stage, said second input being coupled to said second output of said first stage and said third input being coupled to said second input of said filter means; and a final stage having a first input, a second input, a third input, a first output and a second output, said first input being coupled to said first output of said subsequent stage, said second input being coupled to said second output of said subsequent stage, said third input being coupled to said second input of said filter means, said first output being coupled to said output of said filter means and said second output being discarded.

12. The RELP coder of claim 11 wherein said first stage of said filter means of said transmitter comprises:

a first multiplier having a first input, a second input and an output, said first input being coupled to said first input of said first stage and said second input being coupled to said third input of said first stage;

a delay having an input and an output, said input being coupled to said second input of said first stage;

a second multiplier having a first input, a second input and an output, said first input being coupled to said output of said delay and said second input being coupled to said third input of said first stage;

a first subtractor having a positive input, a negative input and an output, said positive input being coupled to said first input of said first stage, said negative input being coupled to said output of said second multiplier and said output being coupled to said first output of said first stage; and a second subtractor having a positive input, a negative input and an output, said positive input being coupled to said output of said delay, said negative input being coupled to said output of said first multiplier and said output being coupled to said second output of said first stage.

13. The RELP coder of claim 12 wherein said subsequent stage of said filter means of said transmitter comprises:

a first multiplier having a first input, a second input and an output, said first input being coupled to said first input of said subsequent stage and said second input being coupled to said third input of said subsequent stage;

a delay having an input and an output, said input being coupled to said second input of said subsequent stage;

a second multiplier having a first input, a second input and an output, said first input being coupled to said output of said delay and said second input being coupled to said third input of said subsequent stage;

a first subtractor having a positive input, a negative input and an output, said positive input being coupled to said first input of said subsequent stage, said negative input being coupled to said output of said second multiplier and said output being coupled to said first output of said subsequent stage; and a second subtractor having a positive input, a negative input and an output, said positive input being coupled to said output of said delay, said negative input being coupled to said output of said first multiplier and said output being coupled to said second output of said subsequent stage.

14. The RELP coder of claim 13 wherein said final stage of said filter means of said transmitter comprises:

a first multiplier having a first input, a second input and an output, said first input being coupled to said first input of said final stage and said second input being coupled to said third input of said final stage;

a delay having an input and an output, said input being coupled to said second input of said final stage;

a second multiplier having a first input, a second input and an output, said first input being coupled to said output of said delay and said second input being coupled to said third input of said final stage;

a first subtractor having a positive input, a negative input and an output, said positive input being coupled to said first input of said final stage, said negative input being coupled to said output of said second multiplier and said output being coupled to said first output of said final stage; and a second subtractor having a positive input, a negative input and an output, said positive input being coupled to said output of said delay, said negative input being coupled to said output of said first multiplier and said output being coupled to said second output of said final stage.

15. The RELP of claim 14 wherein said receiver comprises:

a 2400 BPS receiver having a first input, a second input, a first output and a second output, said first input being coupled to said input of said receiver and said second output being coupled to said output of said receiver; and a 2400 BPS residual receiver having an input and an output, said input being coupled to said first output of said 2400 BPS receiver and said output being coupled to said second input of said 2400 BPS receiver.

16. The RELP coder of claim 15 wherein said 2400 BPS receiver comprises:

deserializer means for deserializing the signal received by said 2400 BPS receiver, said deserializer means having an input, a first output, a second output, a third output, a fourth output, and a fifth output, said input being coupled to said first input of said 2400 BPS receiver and said first output being coupled to said first output of said 2400 BPS receiver;

error correction means for correcting the error caused in transmission of said signal, said error correction means having a first input, a second input, a third input, a first output, a second output and a third output, said first input being coupled to said fourth output of said deserializer means, said second input being coupled to said third output of said deserializer means and said third input being coupled to said second output of said deserializer means;

a first inverse quantizer having an input and an output said input being coupled to said first output of said error correction means;

a second inverse quantizer having an input and an output, said input being coupled to said second output of said error correction means;

a third inverse quantizer having an input and an output, said input being coupled to said third output of said error correction means;

synthesizer means for combining a plurality of signals, said synthesizer means having a first input, a second input, a third input and an output, said first input being coupled to said output of said first quantizer, said second input being coupled to said output of said second quantizer and said output being coupled to said second output of said 2400 BPS receiver;

an exciter having an input and an output, said input being coupled to said output of said third inverse quantizer;

a switch having a control line, a first pole, a second pole, a first position and a second position, said control line being coupled to said fifth output of said deserializer, said first pole being coupled to said output of said exciter, said second pole being coupled to said second input of said 2400 BPS receiver, said first position coupling said output of said exciter to said third input of said synthesizer and said second position coupling said second input of said 2400 BPS receiver to said third input of said synthesizer.

17. The RELP of claim 16 wherein said 2400 BPS residual receiver comprises:

position determining means for determining the position of each impulse of said signal, said position determining means having an input and an output, said input being coupled to said input of said 2400 BPS residual receiver;

denormalizing means for reconstructing a positive half of said signal, said denormalizing means having an input and an output, said input being coupled to said input of said 2400 BPS residual receiver;

symmetrical means for generating the negative portion of said signal from said positive portion, said symmetrical means having an input and an output said input being coupled to said output of said denormalizing means; and positioning means for placing each impulse of said signal in the proper position, said positioning means having a first input, a second input and an output, said first input being coupled to said output of said symmetrical means, said second input being coupled to said output of said position determining means and said output being coupled to said output of said 2400 BPS residual receiver.

* * * * *

UNITED STATES PATENT AND TRADEMARK OFFICE

CERTIFICATE OF CORRECTION

PATENT NO. : 4,742,550

DATED : May 3, 1988

INVENTOR(S) : Bruce Fette

It is certified that error appears in the above-identified patent and that said Letters Patent is hereby corrected as shown below:

Column 13, claim 9, line 62, the first word "means" should be changed to --phase--.

Signed and Sealed this

First Day of November, 1988

*Attest:*

DONALD J. QUIGG

*Attesting Officer*

*Commissioner of Patents and Trademarks*